United States Patent [19]

Meissner

[11] Patent Number: 4,788,818

[45] Date of Patent: Dec. 6, 1988

[54] PROCESS AND APPARATUS FOR REDUCING THE BREAKDOWN QUOTA OR RATE OF STOPPING DEVICES IN A SPINNING OR TWISTING MACHINE

[75] Inventor: Werner Meissner, Hattenhofen, Fed. Rep. of Germany

[73] Assignee: Zinser Textilmaschinen GmbH, Ebersbach/Fils, Fed. Rep. of Germany

[21] Appl. No.: 69,455

[22] Filed: Jul. 2, 1987

[30] Foreign Application Priority Data

Jul. 3, 1986 [DE] Fed. Rep. of Germany ..... 3622407

[51] Int. Cl.[4] ..... D01H 13/16; D01H 13/32

[52] U.S. Cl. ..... 57/264; 57/265; 57/81

[58] Field of Search ..... 57/261, 264, 265, 78, 57/80, 81

[56] References Cited

U.S. PATENT DOCUMENTS

| | | | |
|---|---|---|---|
| 3,899,868 | 8/1975 | Lee et al. | 57/265 X |
| 3,995,417 | 12/1976 | Lumpert et al. | 57/265 |
| 4,194,349 | 3/1980 | Lane | 57/265 |
| 4,420,697 | 12/1983 | Fiedler et al. | 57/81 X |
| 4,512,028 | 4/1985 | Stutz | 57/264 X |
| 4,534,042 | 8/1985 | Marsicek et al. | 57/263 X |
| 4,563,873 | 1/1986 | Tooka | 57/264 |

*Primary Examiner*—Donald Watkins

*Attorney, Agent, or Firm*—Herbert Dubno

[57] ABSTRACT

The process and apparatus of our invention reduces the breakdown quota of stopping devices in a spinning or twisting machine which stop the roving, e.g. when a roving break occurs. A simulated signal for "Yarn Running" is conductable to a stopping device for test purposes and/or the yarn break sensing device can be disconnected from the stopping device and from time to time a connecting signal is produced which reconnects the yarn break device to the associated stop device.

21 Claims, 2 Drawing Sheets

PROCESS AND APPARATUS FOR REDUCING THE BREAKDOWN QUOTA OR RATE OF STOPPING DEVICES IN A SPINNING OR TWISTING MACHINE

FIELD OF THE INVENTION

My present invention relates to a process which allows the reduction of the breakdown quota or rate of stopping devices for the material feed into a spinning or twisting machine. It also relates to an apparatus for performing this process.

BACKGROUND OF THE INVENTION

A spinning or twisting machine can have a plurality of stopping devices which are located at respective work stations of a set of drafting rolls or supply rolls. These stopping devices are each associated with a yarn break sensing device which can activate the stopping device.

A spinning machine making yarn from roving, or a roving spinning machine making yarn from sliver or a twisting machine making twist yarn from two or more yarn strands may contain a plurality of stopping devices which can utilize the process and apparatus of my invention. By yarn I mean sliver roving, simple yarn or twisted plied yarn.

The stopping devices in a spinning machine (e.g. according to U.S Pat. No. 3,636,695) are safety devices which can cause significant problems when they fail. For example as a result of yarn breakage the oncoming sliver, yarn or roving can form around the rolls of the set of drafting rolls and/or the supply rolls and these drafting rolls or supply rolls can be damaged as a result or even destroyed.

By breakdown rate or rate I mean the number of stopping devices (it is assumed that there are a number of work stations and a corresponding number of stopping devices) which are not functioning correctly at the same time, whether that is due to an internal fault or a fault in the yarn-break sensing devices associated with them which do not activate them because of any reason, i.e. they do not trigger when a yarn break occurs.

OBJECTS OF THE INVENTION

It is an object of my invention to provide an improved spinning or twisting machine with stopping devices and an improved process for operating it which will overcome earlier drawbacks.

It is also an object of this invention to provide a process and apparatus for reducing the breakdown rate for stopping devices used in a spinning or twisting machine.

SUMMARY OF THE INVENTION

These objects and others which will become more readily apparent hereinafter are attained in accordance with my invention in a process for reducing the breakdown rate of stopping devices which stop material feed, which are each located at a work station of a set of drafting rolls or supply rolls of a spinning or twisting machine and which have yarn-break sensing devices which can activate the stopping devices.

The electrical connection of a yarn-break sensing device with the associated stopping device can be interrupted automatically as a result of a yarn break.

According to my invention a simulated signal representing "yarn running" and/or "yarn break present" can be conducted to the yarn-break sensing devices and/or the stopping devices for testing of operation to ascertain at which of the work stations the yarn-break sensing devices or the stopping devices are not functioning or not functioning correctly and to overcome the related malfunction in the yarn-break sensing devices or the stopping devices which are not functioning and/or functioning correctly.

Also according to my invention in the case where the electrical connection of the yarn-break sensing devices with the associated stopping devices is interrupted automatically from time to time a connecting signal is produced by which the electrical connection is again made by the yarn break sensors with the yarn running.

The apparatus for performing the process according to my invention comprises a central signal generator for producing a simulated signal "yarn running" and/or "yarn break present" associated with the stopping devices of the spinning or twisting machine and/or a signal generator associated with the yarn-break sensing devices or producing a connecting signal which acts to reconnect the yarn-break sensing devices to the associated stopping devices.

The first embodiment of the process according to my invention in a simple way tests the operation of the stopping devices and/or the yarn-break sensing devices and when faulty operation is detected provides for repair or replacement of the faulty components.

According to the second embodiment of the process the stopping devices which—even though they and the yarn-break sensing device associated with them are intact—for some reason are not activated are activated by a connecting signal so that the roving involved can be halted when a yarn break occurs.

This is especially advantageous at the work stations with yarn breaks for whose elimination the stopping devices must be inactivated or removed.

In the case in which the yarn break can not be eliminated, the activation of the stopping devices by the connecting signal produced in a desired standard or nonstandard time interval is terminated. Thus by these features the breakdown rate of the stopping devices can be reduced in a simple and economical way.

During the operation of the spinning machine the connecting signal can be periodically reproduced and of course appropriately in time intervals which are longer, advantageously much longer, than the time required for the elimination of a yarn break and/or it can be produced after the end of an action eliminating a yarn break at a work station.

It can be provided that in the case of making a connecting signal by a signal source like a clock timer or a state generator this signal source is always disconnected for a time interval while the elimination of the yarn break at the work station occurs. This is particularly advantageous when an automatic yarn starting unit is set for eliminating a yarn break.

The connecting signal can be applied to all work stations simultaneously or can be conducted to or applied in series at each different work station or to groups of work stations It is especially appropriate to generate the connecting signal centrally for all work stations of the spinning or twisting machine and to feed it simultaneously to all work stations At work stations at which the yarn-break sensing devices are disconnected, i.e. the electrical connection between the yarn-break sensing devices and the associated stopping devices is broken, then the connecting signal causes the yarn-break sensing devices to be again reconnected with the stopping devices so that, in case a yarn break is present or occurs at those work stations is, immediately the stopping devices stopping the feed of material are activated. Of course it is particularly appropriate that the reconnection of the yarn-break sensing device to the associated stopping device is also disengaged by the yarn break sensor when it senses the presence of running yarn for a definite time duration.

The disconnection of the yarn-break sensing devices from the associated stopping devices particularly has the purpose that the yarn-break sensing devices can not prevent the removal of a yarn break. For that however at the beginning of a yarn break removal attempt it must be provided that the respective drafting device or delivery device be again fed material, i.e. that first the stopping device must again be deactivated at the appropriate work station which can occur by the appropriate operating person or also can occur automatically by a yarn setting carriage.

When then at the appropriate work station for some reason the yarn break can not be eliminated and thus the yarn break sensor does not reconnect the yarn-break sensing device to the stopping device, the stopping device can not be activated again or this activation can be forgotten.

By applying periodically the connecting signal it is then guaranteed that immediately or in a comparatively short time the activation of the stopping device occurs. Then by the effective reconnection of the stopping device to the yarn-break sensing device and because of the yarn break sensed by it the yarn-break sensing device immediately activates the stopping device to stop the feed of material at this work station.

As mentioned it is appropriately provided that the yarn-break sensing device always then, when it senses after removal of a yarn break that the yarn is again present at this work station or must be after elapse of a predetermined time interval of advantageously a few seconds, e.g. 4 to 10 seconds, reconnects the yarn-break sensing device to the stopping device automatically so that this reconnection can not only occur by the connecting signal but also by the yarn break sensor of the yarn-break sensing devices.

The yarn break sensor can have any suitable structure. For example it can be an inductive yarn break sensor sensing the passing of the traveler rotating on the spinning ring, a photooptical sensor sensing the presence of the yarn or a capacitive, mechanical, piezoelectric or triboelectric yarn break sensor. It can be constructed so that it supplies an output signal varying from zero only when it senses the presence of yarn or running yarn or a yarn break or that it supplies an output signal varying from zero for both these different cases.

Yarn break sensors which cannot sense the presence of yarn with the machine idle are particularly appropriate but they signal the absence of yarn. This output signal "yarn break present" can comprise a substantially zero current or voltage at the output of the yarn break sensor. The testing of the operating of the stopping devices is then particularly simple with the machine idle.

Then the yarn break sensors, when they are connected, signal yarn breaks although yarn is present. One can also in a particularly simple way with the machine idle test the operation of the stopping device by the simulated signal "yarn running".

Also when the yarn break sensors are such that the presence of yarn is sensed, for example with a photoelectric yarn break sensor, the testing of the stopping device operation can be performed likewise with the machine idle. One must provide that the yarn break sensor does not signal the presence of yarn. For this purpose it can advantageously be provided that the yarn break sensor be disconnected or the testing be preformed with the machine idle when a yarn break is present at the work stations, for example is made intentionally, or when as a result of a batch change no yarn is present at the work stations.

It is particularly advantageous when the prevention of the effect of the connecting signal and/or of the disengagement of the connecting signal can, when a yarn starting carriage is present, automatically be controlled by means associated with it or otherwise be effected or, in case the yarn break is manually removed by an operator, the effect of the connecting signal at least on the yarn-break sensing or stopping device can be disconected or prevented by a manually operable switch located at the spinning station.

The apparatus for reducing the breakdown rate of a stopping device for the rollers of a spinning or twisting machine according to my invention comprises a yarn-break sensing device which can activate the stopping device and a central signal generator for making a simulated signal "yarn running" and/or "yarn break present" associated with the stopping device of the spinning or twisting machine and/or the yarn-break sensing device and/or a signal generator associated with the yarn-break sensing device for producing a connecting signal which acts to reconnect the yarn-break sensing device to the stopping device.

A single signal generator can advantageously act to produce both connecting signals and also the simulated signal "yarn running" and/or "yarn break present", the connecting signal and the simulated signal"yarn running" and/or the connecting signal and said simulated signal "yarn break present" being diverted from a single signal supplied by the signal generator to a common main.

In one embodiment of my invention at least one connecting signal at the end of the action taken to eliminate the yarn break at one of the work stations can be disengable by switch means. However when the elimination of the yarn break is not successful at the work station, the connecting signal is conductable at least to one of the yarn-break sensing devices.

The switch means can be provided in an automatically operating yarn starting carriage and is disconnectable by the yarn starting carriage. Alternatively the switch means is advantageously provided in the spinning machine and is disconnectable by an automatically operating yarn starting carriage or an operator. The signal generator can have a timed switch device for cyclically making the connecting signal. The connecting signal can be disengagable exclusively by the yarn starting carriage.

The timed switch device can be always disconnected as long as the yarn starting carriage located in the spinning machine for automatic removal of the yarn break acts at the work stations. Also the output signal from the yarn-break sensing device can disengage the reconnection of the yarn sensing device to the stopping device when the presence of yarn is sensed directly or indirectly and the yarn is run for a predetermined definite short time interval.

BRIEF DESCRIPTION OF THE DRAWING

The above and other objects, features and advantage of my invention will become more readily apparent from the following description, reference being made to the accompanying highly diagrammatic drawing in which.

SPECIFIC DESCRIPTION

Figure 1:
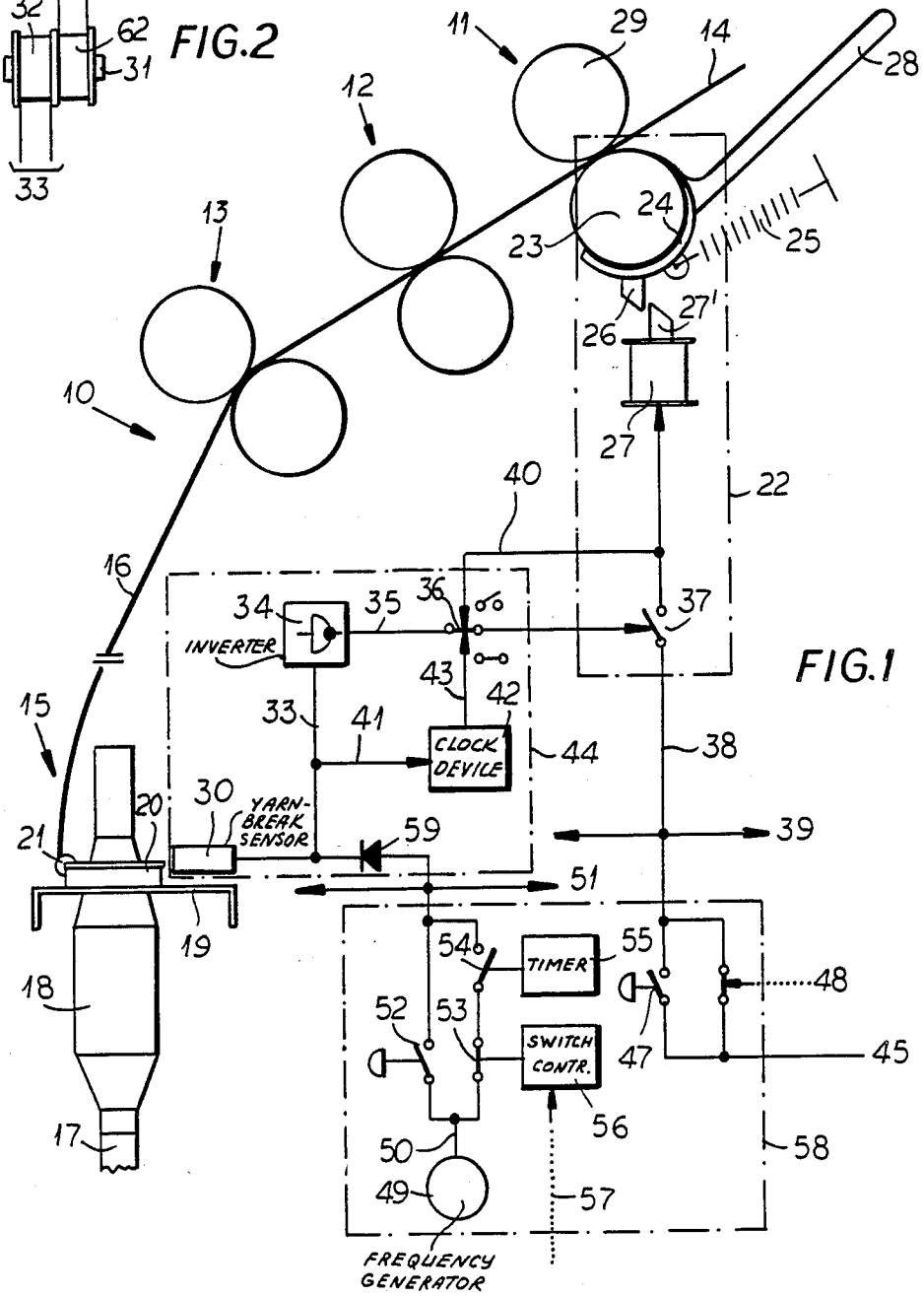
FIG. 1 is a schematic cross sectional view of the essential parts of a spinning machine with a stopping device also including structural components and a circuit diagram of a first embodiment of the apparatus for reducing the breakdown rate of the stopping devices according to my invention.
Figure 3:
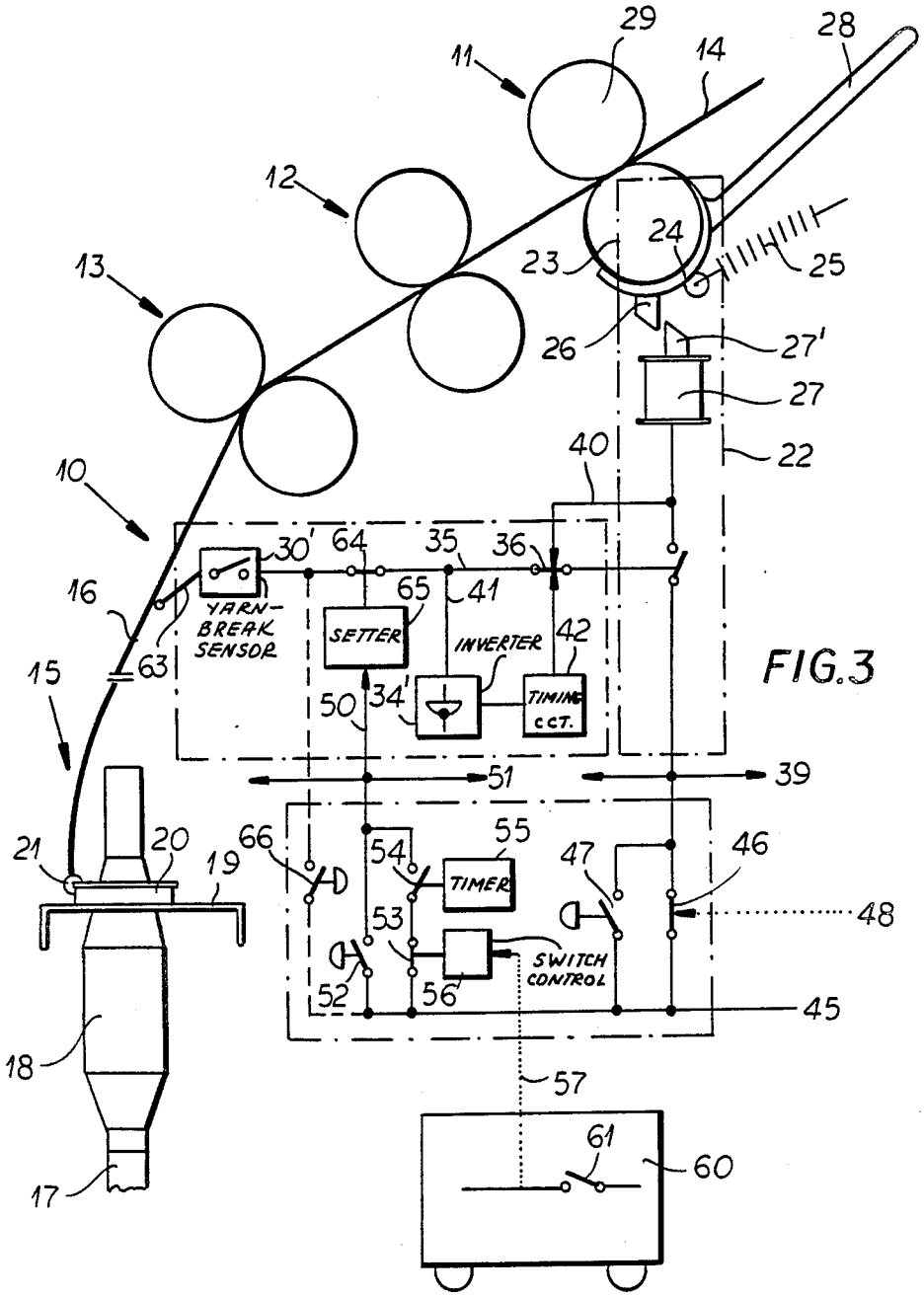
FIG. 3 is a schematic cross sectional view of a spinning machine with a stopping device similar to FIG. 1 with a second embodiment of the apparatus for reducing the breakdown rate of the stopping device according to my invention.

FIGS. 1 and 3 each include a schematic side elevational view of a work station comprising a spinning station 10 of a spinning machine which has a large number of these spinning stations. The spinning station 10 has a set of drafting rolls with three pairs of rolls 11,12 and 13 which draw roving 14 fed from an not-illustrated roving bobbin. This roving 14 is twisted or spun after leaving the supply roll pair 13 by a ring spinning device 15 to yarn 16. It is wound on a bobbin 18 mounted on a spindle 17 by a spinning ring 20 attached to a ring rail 19 moved up and down in operation and a traveler 21 guided on it.

Each spinning station 10 has a known roving stopping device 22 which comprises a shell 24 partially embracing the lower roll 23 of the entrance roll pair 11.

A locally fixed pivotally mounted spring 25 is attached to this shell 24 which is under tension to rotate the shell 24 in a counterclockwise direction. This can be prevented by a catch 26 attached to the shell 24 which engages a catch bolt 27' retractable by an electromagnet 27 below it.

The shell 24 also has a handle 28. The shell 24 can be moved back into its indicated caught position by the handle against the action of the spring 25.

When the roving feed is stopped, the catch bolt 27' is drawn back under control of the electromagnet 27. Then the spring 25 rotates the shell 24 in the counterclockwise direction. As a result the shell 24 with its cutter like front edges moves onto the clamping line of the roll pair 11 and lifts the upper roll 29 from the lower roll 23. In this position the shell 24 is held fixed by contact so that the roving 14 is blocked between the shell 24 and the stopped upper roll 29.

To end this blocking the shell 24 is moved back in the clockwise direction by the handle 28 until the catch 26 falls in behind the catch bolt 27'. As a result the upper roll 29 is lowered on the running lower roll 23 and the transport of the roving 14 again proceeds.

In the embodiment of FIG. 1 a yarn break sensor 30 is positioned at each work station of the machine on the ring rail 19. This yarn break sensor 30 is an inductive action yarn break sensor 30. It comprises a rod like permanent magnet whose one pole is positioned close to the rotation path of the Fe metal spinning traveler 21. On rotation of the spinning traveler 21 on the spinning ring 20 this magnetic field changes on every pass of this by the permanent magnet 31. This induces a current and/or voltage in a coil 32 mounted on the magnet 31 whose amplitude varies with the frequency of the rotating spinning traveler 21.

When the yarn breaks and the spinning traveler 21 halts this voltage does not occur. The yarn break sensor 30 thus supplies a yarn running signal—the yarn break signal is the inverse of this yarn running signal. It is understood that on stopping the machine no yarn running signal is delivered even when the yarn is present.

The yarn break sensor 30 is connected by a conductor 33 with an inverter 34 (e.g. a flip flop). The output of this inverter 34 is connected by a conductor 35 and an opening or breaking switch 36 with a closing or making switch 37. This switch 37 is located in a conductor 38 connecting a power supply conductor 39 and the disengaged electromagnet 27 of the stopping device 22.

An additional conductor 40 branches from this conductor 38 between the switch 37 and the electromagnet 27. It acts on opening or breaking switch 36 to open it. The output of the yarn break sensor 30 is further connected by a conductor 41 with a clock device 42 which acts on the switch 36 by conductor 43 to close it.

The previously described elements 30, 34, 36 and 42 form a yarn-break sensing device 44. One yarn-break sensing device 44 is present at each work station.

An opening or breaking switch 46 and a closing or making switch 47 are connected in parallel between the main line 45 and the power supply conductor 39 from which the conductor 38 branches to the closing or making switch 37 of the single stopping device 22 of the spinning station 10. The opening or breaking switch 46 is controlled by the operating line 48 of the not-illustrated machine control so that it is open at a certain rotation speed of the spindle 17 of the ring spinning machine. The closing or making switch 47 is closed in a way to be described in more detail later manually.

A frequency or signal generator 49 which is suitable for a frequency in the range of the frequencies generated in the yarn break sensor 30 by the spinning traveler 21 is connected by a conductor 50 with a power supply line 51 which is connected by the tie line to the conductor 33 extending from the outlet of the yarn break sensor 30 in the individual spinning stations 10.

Diodes 59 in this tie line prevent the yarn running signal from the running yarn sensed by the yarn-break sensing device 30 from being fed by the power supply conductor 51 into yarn-break sensing devices 44 of other spinning stations in which the yarn breaking sensor 30 senses no running yarn.

The conductor 50 is branched, with one branch connected to the switch 52 which can be closed manually in a way to be described later. In the other branch from the conductor 50 an opening or breaking switch 53 is connected in series with the closing or making switch 54.

The closing or making switch 54 is controlled by a clock device 55 in a regulated time interval for an adjustable time. The adjusting member 56 of the opening or breaking switch 53 is opened by a operating line 57 in a way to be described in more detail later.

The previously described elements 45 to 56 form a testing device 58 one of which is present in each spinning machine and which controls the yarn-break sensing devices 44 and/or the stopping devices 22 of all the spinning stations 10 of a spinning machine by both power supply conductors 39 and 51.

The traveler 21 feeding the yarn 16 on the spinning ring 20 in normal operation of the machine generates a yarn running signal in the yarn-break sensing device 30 which produces no signal at the outlet of the inverter 34. When the yarn running signal of the yarn-break sensing device contacts for an adjustable minimum time on the clock device 42 this timing device or clock device closes the closing or making switch 36.

In the case of a yarn break, the yarn running signal does not occur. As a result a signal is produced at the outlet of the inverter 34 which closes the switch 37 because of the closed switch 36 and connects the electromagnet 27 of the appropriate spinning station with the main line 45 and with that releases the roving stopping device 22 in this spinning station by pulling away the catch bolt 27'.

Then the switch 36 is acted on by the conductor 40 to open it so that the closed switch 37 is then opened after a short time and the magnet 27 is deenergized.

In this situation the feed of the roving 14 to the drafting rolls 11, 12 and 13 is again blocked; however the stopping device 22 can be reset manually for again engaging the roving feed to eliminate the effects of the broken yarn remaining.

If the yarn break removal is successful, the yarn-break sensing device 30 again delivers a yarn running signal. As a result the releasing signal at the output of the inverter 34 disappears while the clock device 42 closes the opening or breaking switch 36 as soon as the yarn running signal is provided for an adjustable minimum time and thus prepares the switch for the delivery of the next yarn break signal.

So that the stopping device 22 can again be released in an unsuccessful yarn starting attempt, the switch 54 is closed by the timed switch member 55 in a time interval of for example a minute for approximately a bit more than the time for which a yarn running signal must dwell in the clock device 42 so that it closes the switch 36. As a result running yarn is simulated by the frequency or signal generator 49 communicating with the clock device 42 and it closes the switch 36. When after again shutting off the yarn running signal simulated by the frequency generator 49 no yarn running signal is detected at the working station having a yarn break by the yarn break sensor, the inverter 34 releases a shut off signal and the roving input stops.

At spinning stations at which no yarn break occurs and at which a yarn running signal is delivered by a yarn breaking sensing device 30 the simulated yarn running signal remains without effect. However the simulated yarn running signal has the effect that at work stations at which the yarn runs the closing of the switch 36 does not occur however in a defective way, the closing of the switches is made up for or recovers and thus the yarn-break sensing device 44 is made "sharp" or "abrupt", i.e. of the quick-response type.

So that during a yarn starting attempt this abruptness in the yarn-break sensing device 44, which would as a result of defective yarn release again the yarn stopping device 22 and thus the yarn starting process would be disturbed, can be compensated it is provided that the delivery of the simulated yarn running signal is stopped by opening the switch 53.

The opening of this switch 53 can occur by a remote action communicated over the working line 57 or by an operator who can activate an not-illustrated switch acting on the controlling member 56 of the switch 53.

A guarantee against unintended abruptness in the yarn-break sensing device 44 is however particularly important during use of an automatic yarn piecing unit. That sort of disturbing effect could not be detected as such or appropriately reacted to with automatic starting. For this purpose as shown in the embodiment of FIG. 3 it is provided that the switch 61 which switches on the yarn starting mechanism in a yarn piecing unit 60 is connected galvanically or wirelessly by the working line 57 with the adjusting member 56 in such a way that the switch 53 is opened as long as the switch 61 is closed.

Figure 4:
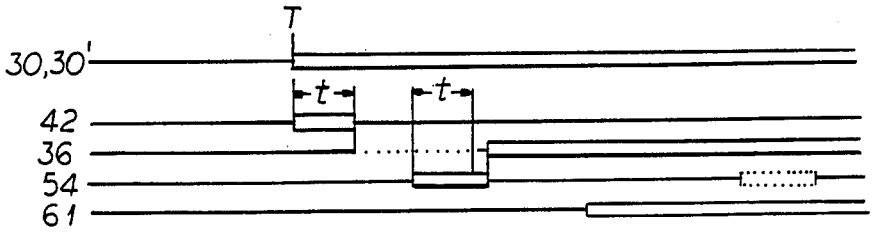
FIG. 4 is a diagram showing the state of various components of the yarn break device during engagement of the disengaged stopping device in which the state of the controlling member is shown on the ordinate and the time is shown on the abscissa.

In the functional diagram of FIG. 4 the time course of the "making abrupt or sharp" process for a stopping device after overcoming of a yarn break at time T is illustrated:

Upon eliminating the yarn break a yarn running signal illustrated by the bar originating at time, T, is produced—in the embodiment of FIG. 1 directly at the yarn break sensor 30, in the embodiment of FIG. 3 at the outlet of the inverter 34'. When the yarn running signal resides in the clock device 42 for the illustrated minimum time interval, t, it must close the switch 36 (shown by the bars). If it ceases (dashed line), running yarn is simulated to the clock device 42 and thus once more the switch 36 is closed later by closing the switch 54 for a time interval of somewhat longer duration that the time interval t which causes the clock device 42 to close the switch 36.

In case of a yarn piecing process with closing of the switch 61 in the yarn piecing unit 60 the next simmulation process of the running yarn caused by closing the switch 54 is suppressed by opening of the switch 53 (dotted).

So that in the idle machine no release of a stopping device 22 by the then not rotating spinning traveler 21 occurs, the switch 46 is opened on starting and stopping of the machine by its controller acting over the working line 48 and thus the power supply conductor 39 is currentless or dead as long as the spindle rotation speed is reduced so that an insufficiently strong signal is produced by the traveler 21 in the yarn-break sensing device 30.

To check the yarn-break sensing device 44 and the stopping device 22 in its operation with the machine stopped, also in the absence of yarn running signals from the yarn break sensor 30 and the switch 46 opened, running yarn is simulated in the yarn-break sensing device 44 at all spinning stations of a spinning machine by closing the switch 52 manually. Then by closing the switch 47 the power supply conductor 39 is connected to the main line 45 by closing the switch 47. In the spinning stations in which now the stopping device 22 responds either the yarn-break sensing device 44 or the stopping device 22 is defective and must be repaired or replaced.

In a second testing step the switch 52 is opened and thus the simulation of running yarn ceased. Now all stopping devices of the machine must respond—at work stations at which the stopping devices do not respond, the yarn-break sensing device 44 or the stopping device 22 is defective and must be repaired or replaced.

Figure 5:
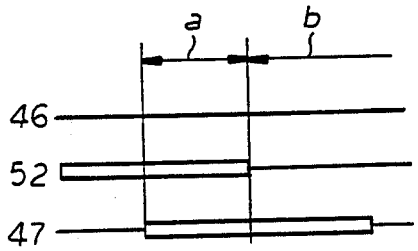
FIG. 5 is a diagram of a test run similar to FIG. 4.

The time course of the testing process is clearly indicated as follows in the operational diagram of FIG. 5:

With the switch 46 (thin line) open, first switch 52 for the purpose of simulation of running yarn, then switch 47 for energy supply to the stopping device are closed.

In the overlapping time interval a where both switches 52, 7 are closed no stopping device may respond.

Then when the switch 52 is opened to suppress the running yarn simulation, all stopping devices must respond.

Figure 2:
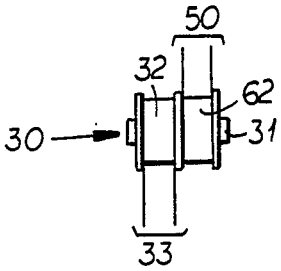
FIG. 2 is a side view of a part used in the apparatus of my invention which has a structure different from the corresponding part in the embodiment of FIG. 1.

This testing process does not extend to the yarn break sensor 30 when the simulation signal first is conducted from its source into the switch. To incorporate the yarn break sensor 30 in the testing the simulation signal "yarn running" in the form of a frequency supplied by the frequency generator 9 is fed to a coil 62 (FIG. 2) which is located beside the coil 32 on the permanent magnet 31.

So that yarn running is simulated for the yarn break sensor 30 by induction of the current in the coil 32 and it is to that extent incorporated in the testing, then, when it delivers no signal, the stopping device 22 releases and thus engages.

In FIG. 3 the elements which correspond to those described in regard to FIG. 1 are provided with the same reference numbers and are not described in detail or further. A yarn break sensor 30' is provided which senses the present yarn and accordingly with the yarn absent or present delivers a signal independently of the whether the yarn is running or not running.

In the embodiment of FIG. 3 the yarn break sensor 30' has a key strap 63 contacting lightly on the yarn under pressure from an not-illustrated spring. The key strap 63 is held in a first position by the yarn. When the yarn is broken however it pivots under action of the spring and closes a switch in the yarn break sensor 30'. Also capactive or optical light sensors are suitable,i.e. their signal delivery depends on the presence or absence of yarn independently of its motion. These elements are also represented by the strap 63.

As a result the yarn break sensor 30' supplies a yarn break signal on yarn breaking, i.e. the switch in the yarn-break sensing device is closed. In other cases an inverter must be connected following it which would release an adjusting signal on opening of the switch and thus on suppression of the yarn present signal. When no signal is delivered with yarn running by the yarn break sensor 30' (after elimination of a yarn break), the clock device 42 must close the switch 36 however after the signal is allowed to persist for the set time. A inverter 34 is connected in this embodiment in the conductor 41 to this clock device 42 by which the clock device 42 is acted on with a signal with the yarn running and closes the switch 36 as soon as the signal is applied for the provided time interval.

Since no yarn break signal is delivered in the operation of the described yarn break sensor 30' also on halting of the machine, when yarn is present then the switch 46 could be abandoned. Frequently the tension in the yarn on stopping the machine decreases so much that the yarn break sensor 30' delivers a false yarn break signal. To prevent this, in this embodiment the switch 46 is significant and suitable.

The operation of this apparatus on occurrence of a yarn break and on elimination of a yarn break corresponds to that already described in connection with the embodiment of FIG. 1, i.e. a yarn break signal is conducted by the conductor 35 and the switch 36 to the switch 37 which releases the stopping device 22.

To also be able to test the operation of the yarn-break sensing device 44 and the stopping device 22 an opening or breaking switch 64 is connected in the conductor 35 between the yarn break sensor 30' and the switch 36 which can be opened by a control member 65. The control member 65 is connectable by the power supply conductor 51 to the main line 45.

The testing is also performed when no yarn is present, also when the machine is overridden or when it is changed to another batch—then also frequently no yarn is present. As a consequence the switches are closed in all yarn-break sensing devices 30' and the yarn break signal is delivered.

To stop the delivery of this yarn break signal the switch 64 at all spinning stations is opened by closing the switch 52 by the control member 65. Then by closing the switch 47 the power supply conductor 39 is connected to the main line 45. At the spinning stations at which stopping devices are now responding, either the yarn-break sensing device 44 or the stopping device 22 is defective and must be repaired or replaced.

In the second testing step the switch 52 is opened and the switch 64 is closed. Now at all spinning stations yarn break signals are present and correspondingly all stopping devices 22 of the machine respond—at work stations at which stopping devices do not respond the yarn-break sensing device 44 or the stopping device 22 is defective and must be repaired or replaced.

For the testing to take this course it is presumed that the machine is without yarn and in the second testing step or step yarn break signals are present at all spinning stations. In this testing the yarn break sensor 30' is incorporated with it. To perform this testing also in a machine in which yarn is present a switch 66 can be provided which connects the circuit 45 with the conductor 35 in the yarn-break sensing device 44 of all spinning stations 10—advantageously by a power supply line 39 and/or 51 or a similar not-illustrated power supply line. With that a yarn break can be simulated by all yarn-break sensing devices, also when yarn is present in them.

By "switch means" in the following claims I mean a manually operable switch 52 connected near the signal generator 49. The "timed switch device" comprises the clock device 55 together with the switch 54. By "common main" I mean a power supply conductor or line such as 39 or 51 which supplies power or connects all the yarn-break sensing devices 44 at all the spinning stations of the spinning or twisting machine. By "common conductor" I mean essentially the same as I mean by a common main.

I claim:

1. In a process for reducing the breakdown rate of a plurality of stopping devices which are located at a plurality of work stations of a set of drafting rolls or supply rolls of a spinning or twisting machine and which have a plurality of yarn-break sensing devices which can activate said stopping devices, the improvement wherein a simulated signal "yarn running" and/or "yarn break present" is conducted to said yarn-break sensing devices and/or said stopping devices for testing of operation to ascertain at which of said work stations said yarn-break sensing device or said stopping device is not functioning or functioning incorrectly and to overcome any malfunction in said yarn-break sensing device or said stopping device which is not functioning and/or functioning incorrectly.

2. The improvement according to claim 1 wherein to test the operability of said yarn-break sensing devices and/or said stopping devices the presence or absence of yarn is simulated for said yarn-break sensing devices, and said stopping devices which can not be activated or are activated erroneously inspite of this simulation are detected.

3. The improvement according to claim 3 wherein for testing the operability of said yarn-break sensing devices and/or said stopping devices the current supply for said stopping devices is disconnected; a yarn break is produced at said work stations or a state is produced which simulates said yarn break for said yarn-break sensing devices, said simulated signals "yarn running" being conducted to said yarn-break sensing devices or said presence of said yarn being simulated in other ways which connect said current supply to said stopping devices and then said stopping devices which are activated are detected and for further testing said simulated signals "yarn running" are ended and/or said simulated signal "yarn break present" is fed to said yarn-break sensing device and then said stopping devices which are not activated are detected.

4. In a process for reducing the breakdown rate of a plurality of stopping devices which are located at a plurality of work stations of a set of drafting rolls or supply rolls of a spinning or twisting machine and which have a plurality of yarn-break sensing devices which can activate said stopping devices, the electrical connection of each of said yarn-break sensing devices with the associated one of said stopping devices being interrupted automatically as a result of a yarn break, the improvement wherein from time to time a connecting signal is produced by which said electrical connection which was interrupted is again made by said yarn break sensor with yarn running.

5. The improvement according to claim 3 wherein said yarn-break sensing devices are each associated with a clock device for the case in which said yarn-break sensing device is disconnected from the associated one of said stopping devices which reconnects said yarn-break sensing device to said stopping device only when a connecting signal for doing so is impressed on said clock device for a predetermined minimum time.

6. The improvement according to claim 5 wherein said connecting signal is suppled by a central signal generator common to all of said working stations of said spinning or twisting machine.

7. The improvement according to claim 6 wherein in a standard time interval said connecting signal is produced automatically.

8. The improvement according to claim 5 wherein the effect of said connecting signal on said yarn-break eensing device of one of said work stations is always prevented from occurring when an action is taken which eliminates said yarn break at said work station.

9. The improvement according to claim 5 wherein as a result of an action for eliminating said yarn break at said work station by an operator or which takes place with the aid of a yarn starting carriage at least then, when said yarn break can not be eliminated on said work station, said connecting signal is disengaged.

10. In an apparatus for reducing the breakdown rate of a plurality of stopping devices which are located at a plurality of work stations of a set of drafting rolls or supply rolls of a spinning or twisting machine provided with said stopping devices which are each associated with a yarn-break sensing device which can activate said stopping device, the improvement comprising a central signal generator for making a simulated signal "yarn running" and/or "yarn break present" associated with said stopping device of said spinning or twisting machine and/or said yarn-break sensing device and/or one of said signal generators associated with said yarn-break sensing devices for producing a connecting signal which reconnects said yarn-break sensing devices with said stopping devices.

11. The improvement according to claim 10 wherein a single one of said signal generators produces both said connecting signal and said simulating signal "yarn running" and/or said simulated signal "yarn break present", said connecting signal and said simulated signal "yarn running" and/or said connecting signal and said simulated signal "yarn break present" are derived from a single signal supplied by said signal generator to a common conductor.

12. The improvement according to claim 11 wherein at least one connecting signal is deactivated by a switch means at the end of a yarn break removal attempt at a spinning station, when said yarn break removal attempt is not successful, said connecting signal being conductable to at least to one of said yarn-break sensing devices.

13. The improvement according to claim 12 wherein said switch means are provided in an automatically operating yarn starting carriage and are disconnectable by said yarn starting carriage.

14. The improvement according to claim 12 wherein said switch means are provided in said spinning machine and are disconnectable by an automatically operating yarn starting carriage or an operator.

15. The improvement according to claim 12 wherein said signal generator has a timed switch device for cyclically making one of said connecting signal.

16. The improvement according to claim 12 wherein said connecting signal is disengagable exclusively by said yarn starting carriage.

17. The improvement according to claim 15 wherein said timed switch device is always disconnected as long as yarn starting carriage located in said spinning machine for automatic removal of said yarn break acts at said work station.

18. The improvement according to claim 17 wherein also said output signal from said yarn-break sensing device can disengage said reconnection of said yarn sensing device to said stopping device when the presence of yarn is sensed directly or indirectly and said yarn is run for a predetermined definite short time interval.

19. A process for reducing the breakdown rate of a plurality of stopping devices which are located at a plurality of work stations of a set of drafting rolls or supply rolls of a spinning or twisting machine and which have a plurality of yarn-break sensing devices which can activate said stopping devices comprising:

(a) disconnecting said stopping devices from a supply of electric current;

(b) conducting a simulated signal "yarn running" and/or "yarn break present" to said yarn-break sensing device or simulating the presence of running yarn in some other way which connects said supply of said electric current to said stopping devices;

(c) ascertaining which of said stopping devices are activated in step b ;

(d) replacing and/or correcting the malfunction in said stopping devices which are activated in step b ;

(e) ending said simulated signal "yarn running" or said simulating of said running yarn;

(f) conducting a simulated signal "yarn break present" to said yarn-break sensing devices;

(g) ascertaining which of said stopping devices is not activated in step f; and (h) replacing or correcting said malfunction in said stopping devices which are not activated in step f.

20. A process according to claim 19 further comprising:

disconnecting said yarn-break sensing devices for restart or testing of said restart of said spinning or twisting machine; and providing a centrally generated signal for reconnecting said yarn-break sensing devices to said stopping devices only if a successful action is taken to eliminate a yarn break or said simulated signal "yarn break present" for a predetermined minimum time.

21. An apparatus for reducing the breakdown rate of a plurality of stopping devices which are located at a plurality of work stations of a set of drafting rolls or supply rolls of a spinning or twisting machine provided with said stopping devices which are each associated with a yarn-break sensing device which can activate said stopping device comprising:

a central signal generator for making a simulated signal "yarn running" and/or "yarn break present" associated with said stopping device of said spinning or twisting machine and/or said yarn-break sensing device and/or one of said signal generators associated with said yarn-break sensing device for producing a connecting signal which acts to reconnect said yarn-break sensing device to said stopping devices after disconnection which also produces a simulated signal "yarn running" and/or "yarn break present", said connecting signal and said simulated signal"yarn running" and/or said connecting signal and said simulated signal "yarn break present" being diverted from a single signal supplied by said signal generator to a common main;

a timed switch device associated with said signal generator for cyclically producing said connecting signal; and switch means connected with said signal generator for disengaging at least one of said connecting signals at the end of an action taken to eliminate a yarn break at one of said work stations, when elimination of said yarn break is not successful at said work station, said connecting signal being conductable at least to one of said yarn-break sensing devices.

* * * * *